US009524836B2

(12) United States Patent
Ozil et al.

(10) Patent No.: US 9,524,836 B2
(45) Date of Patent: Dec. 20, 2016

(54) ARC-CONTROL CHAMBER GEAR FOR TWO CONFINED CONTACT ELECTRODES

(75) Inventors: Joël Ozil, St Andre de Corcy (FR); René Rosset, Villette d'Anthon (FR)

(73) Assignee: ALSTOM TECHNOLOGY LTD., Baden (CH)

( * ) Notice: Subject to any disclaimer, the term of this patent is extended or adjusted under 35 U.S.C. 154(b) by 162 days.

(21) Appl. No.: 13/805,930

(22) PCT Filed: Jul. 12, 2011

(86) PCT No.: PCT/EP2011/061818

§ 371 (c)(1),
(2), (4) Date: Jan. 31, 2013

(87) PCT Pub. No.: WO2012/007447

PCT Pub. Date: Jan. 19, 2012

(65) Prior Publication Data

US 2013/0126481 A1 May 23, 2013

(30) Foreign Application Priority Data

Jul. 16, 2010 (FR) ..... 10 55800

(51) Int. Cl.
*H01H 33/02* (2006.01)
*H01H 33/90* (2006.01)
*H01H 33/91* (2006.01)

(52) U.S. Cl.
CPC ..... *H01H 33/02* (2013.01); *H01H 33/901* (2013.01); *H01H 33/91* (2013.01)

(58) Field of Classification Search
CPC ..... H01H 33/90; H01H 33/91; H01H 33/901; H01H 2033/908; H01H 33/04; H01H 1/06; H01H 2033/028; H01H 2033/6667; H01H 2033/888; H01H 21/36; H01H 2203/024; H01H 33/245; H01H 33/7023; H01H 3/42; H01H 3/46; H01H 85/046; H01H 89/06; H01H 9/342
(Continued)

(56) References Cited

U.S. PATENT DOCUMENTS 4,393,291 A * 7/1983 Stewart ..... H01H 33/7023 218/13
4,431,887 A * 2/1984 Sturzenegger ..... H01H 33/91 218/61
(Continued)

FOREIGN PATENT DOCUMENTS

DE 10125101 A1 11/2002
EP 0744759 A1 11/1996
(Continued)

OTHER PUBLICATIONS

International Search report dated Oct. 13, 2011 for PCT/EP2011/061818.
(Continued)

*Primary Examiner* — Truc Nguyen
(74) *Attorney, Agent, or Firm* — Pearne & Gordon LLP

(57) ABSTRACT

An arc-control chamber gear for contact electrodes, the gear possessing openings in collars of an electrode centering cap so as to break the confinement of the electrodes and allow them to be ventilated by gas convection between the inside volume heated by the flow of current and the cooler outside volume.

10 Claims, 4 Drawing Sheets

(58) Field of Classification Search
USPC ..... 218/13, 45–47, 51–59, 67–73, 76, 81, 218/154, 156, 157
See application file for complete search history.

(56) References Cited

U.S. PATENT DOCUMENTS

| | | | | |
|---|---|---|---|---|
| 4,445,018 | A * | 4/1984 | Holmgren | H01H 33/905 218/59 |
| 4,663,504 | A * | 5/1987 | Barkan | H01H 33/02 200/302.3 |
| 4,841,108 | A * | 6/1989 | Hamm | H01H 33/91 218/57 |
| 5,478,980 | A | 12/1995 | Freeman | |
| 5,654,532 | A * | 8/1997 | Meyer | H01H 33/91 218/51 |
| 5,723,840 | A * | 3/1998 | Bojic et al. | 218/57 |
| 6,163,001 | A * | 12/2000 | Zehnder et al. | 218/46 |
| 6,495,785 | B1 | 12/2002 | Meyer | |
| 8,389,886 | B2 * | 3/2013 | Dahlquist et al. | 218/45 |
| 2002/0113040 | A1 * | 8/2002 | Imamura | H01H 33/91 218/43 |
| 2007/0068904 | A1 * | 3/2007 | Dahlquist et al. | 218/59 |
| 2008/0135522 | A1 * | 6/2008 | Ye | H01H 33/74 218/76 |

FOREIGN PATENT DOCUMENTS

| | | | |
|---|---|---|---|
| EP | 0836209 | A2 | 4/1998 |
| EP | 1 768 150 | A1 | 3/2007 |
| EP | 2 369 608 | A1 | 9/2011 |
| JP | 53-62180 | | 6/1978 |
| JP | 2-133843 | U | 11/1990 |
| JP | 2507987 | Y2 | 5/1996 |
| WO | 92/14255 | A1 | 8/1992 |

OTHER PUBLICATIONS

Opposition to European Patent EP 2 593 954 dated Dec. 11, 2015.
Dubbels Taschenbuch fur den Maschinenbau, Springer-Verlag, Berlin/Gottingen/Heidelner, 11th Edition, 1953.
Herausgegeben Von Hubert Grafen, VDI Lexikon Werkstofftechnik, VDI-Verlag Dusseldorf, 1993, ISBN 3-18-401328-6, pp. 343-344.

* cited by examiner

ARC-CONTROL CHAMBER GEAR FOR TWO CONFINED CONTACT ELECTRODES

The present invention relates to arc-control chamber gear for two confined contact electrodes, in particular in circuit breakers or switches in high-voltage equipment.

Many kinds of gear include an insulating cap joining together contact carriers in which the contact electrodes slide and surrounding said electrodes. A main function of such an insulating cap is to ensure that the electrodes remain on the same axis, thereby facilitating the opening and closing operations of the contacts. They are used frequently with electrodes that are placed on a horizontal axis, since gravity forces can cause them to sag.

Nevertheless, particular difficulties arise in the volume that is confined by the cap. The heating produced by the flow of current from one electrode to the other firstly limits the nominal current that can pass through the installation. The situation is made more difficult when opening the contact electrodes, since an electric arc occurs briefly and produces a large amount of heat and a considerable amount of extra pressure in the gas surrounding the arc, and this can cause the cap to explode.

One known measure consists in placing openings behind the electrodes in order to exhaust the gas at excessively high pressure as produced by the electric arc when the contacts are open. The hot gas then returns into the volume surrounding the electrodes and around the cap.

A first object of the invention is to limit the heating of the electrodes while the gear is in ordinary operation, with its contacts closed, in spite of the confinement that is produced by the cap.

The invention provides arc-control chamber gear comprising two contact electrodes movable between a closed position and an open position, two contact carriers supporting the electrodes, and a cap joining the contact carriers together and surrounding the facing portions of the electrodes, the cap comprising a main dielectric portion and two collars connecting the ends of the main portion to the contact carriers, the gear being characterized in that the collars are provided with openings causing an inside volume inside the cap in which said facing portions of the electrodes extend to communicate with an outside volume outside the cap and surrounding the inside volume.

The openings are formed through the collars, which may be made of conductive material that is easy to machine, thereby allowing gas convection to take place through the cap, and thus continuously renewing the hot gas inside the cap with cooler gas from outside the cap. It should be emphasized that this arrangement of openings through the collars rather than through the main portion of the cap gives rise to significant advantages: it is easy to make openings in the collars, either by machining given that the collars are frequently made of metal, or during fabrication of the collars by molding or by some other method, regardless of whether the collars are made of metal or of a polymer or composite material, while nevertheless retaining sufficient mechanical strength because of the greater freedom available in designing the collars; whereas making a hole in the main portion of the cap, which would appear to be a better approach since it is a thinner cylinder and gives access to the center of the confined volume, turns out in reality to give rise to greater drawbacks since the main portion of the cap is its weakest portion and since it is normally made of insulating fibers: drilling holes therein necessarily affects the mechanical strength of the cap as a whole, and also its dielectric strength, since the tips of fibers that have been cut by the machining might encourage paths for the flow of electricity.

Another difficulty appears with the above-mentioned situation of exhausting the hot gas that is produced by the arc into the volume surrounding the cap: this gas runs the risk of entering into the volume confined by the cap through the openings and of causing arcs to be re-struck between the electrodes because of the high plasma content of the gas. Nevertheless, this can also be avoided in preferred embodiments of the invention by sheltering the openings for the flows of hot gas, which is easy if the openings are at the ends of the cap, in the collars, and would be more difficult using openings in the center of the cap in register with the junction between the electrodes where the surrounding volume needs to be designated. In a corresponding preferred arrangement, the collars are provided for this purpose with continuous partitions projecting in a radial direction and separating the openings of the adjacent volumes through which the hot gases are exhausted and thus sheltering the openings: the volume surrounding the cap is invaded by hardly any of the hot gas, so the gas has no chance of crossing it.

The invention may be improved in various other aspects. If each collar has a support ring on the corresponding contact carrier and an inside portion for supporting the main portion of the cap, with the continuous partitions joining the support rings and with the openings extending between the continuous partitions and the inside portions, a front bushing may be joined to the continuous partition so as to surround the inside portion, with the openings then also extending between the inside portion and the front bushing: the front bushing contributes to providing better shelter for the openings, while enhancing the dielectric strength of the gear.

In a convenient construction, the inner portions are assembled to the continuous partitions (by distinct means, such as screws) and the openings extend between tabs formed on the continuous partitions and against which the inner portions bear.

Each front bushing may include, at a free end, a rounded bead that projects towards the main portion of the cap.

In a preferred arrangement, each contact carrier includes an outer edging defining a flow path for gas away from an open rear end of the corresponding electrode, the edgings opening out towards the continuous partitions and the collars including respective rear bushings joined to the continuous partitions and surrounding the outer edging at one end. This arrangement enables the hot gas coming from the electrodes when the arc is formed to be intercepted by the continuous partitions and to be deflected away from the cap and the junction zone between the electrodes.

The inner portions of the collars may also carry respective field electrodes, the field electrodes surrounding the contact electrodes and the openings also extending between the contact electrodes and the field electrodes.

In a preferred arrangement, which can improve the quality of the convection flow, the openings occupy an angular portion of one of the collars and an opposite angular portion of the other collar.

The invention is described below in detail with reference to the following figures.

Figure 1:
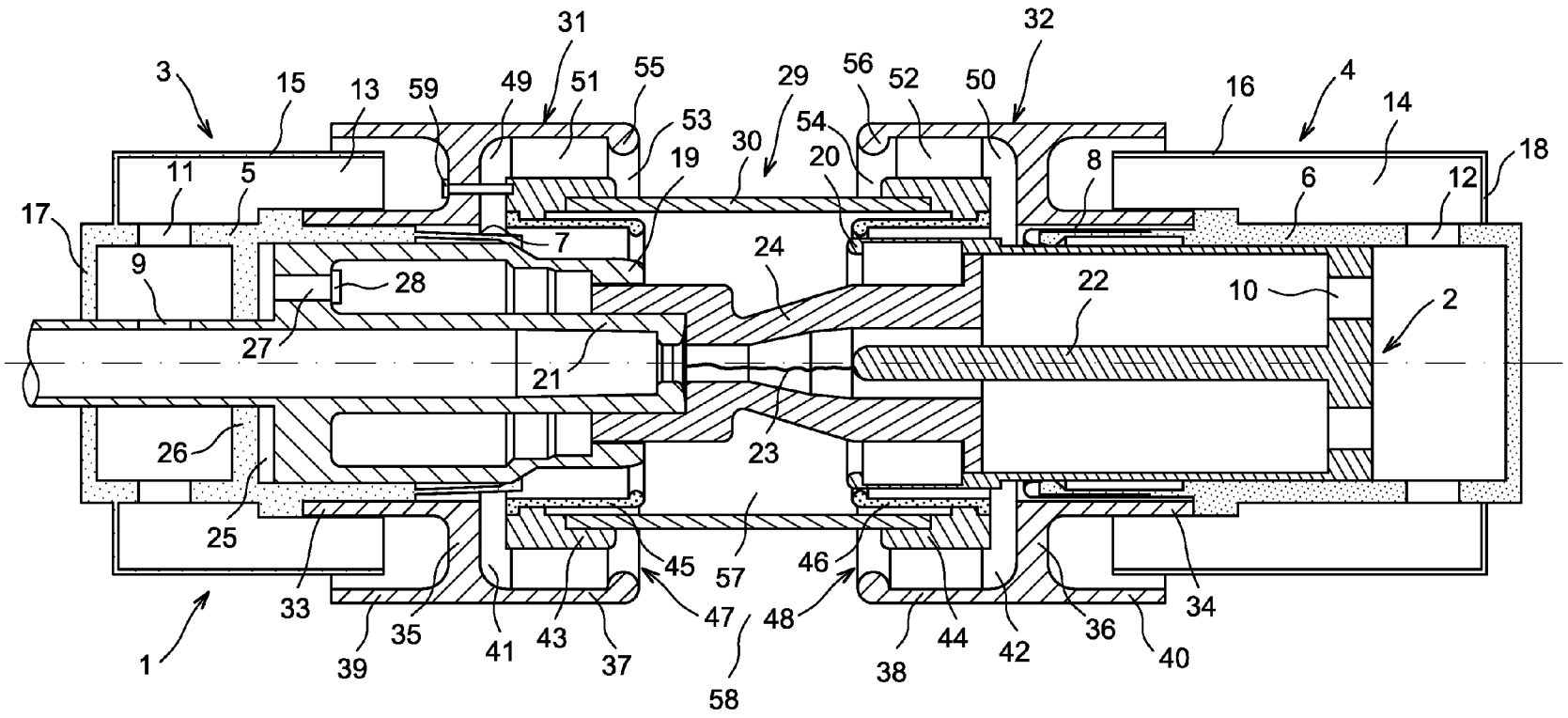
FIG. 1 shows a first embodiment of the invention with the contacts in the open state.
Figure 4:
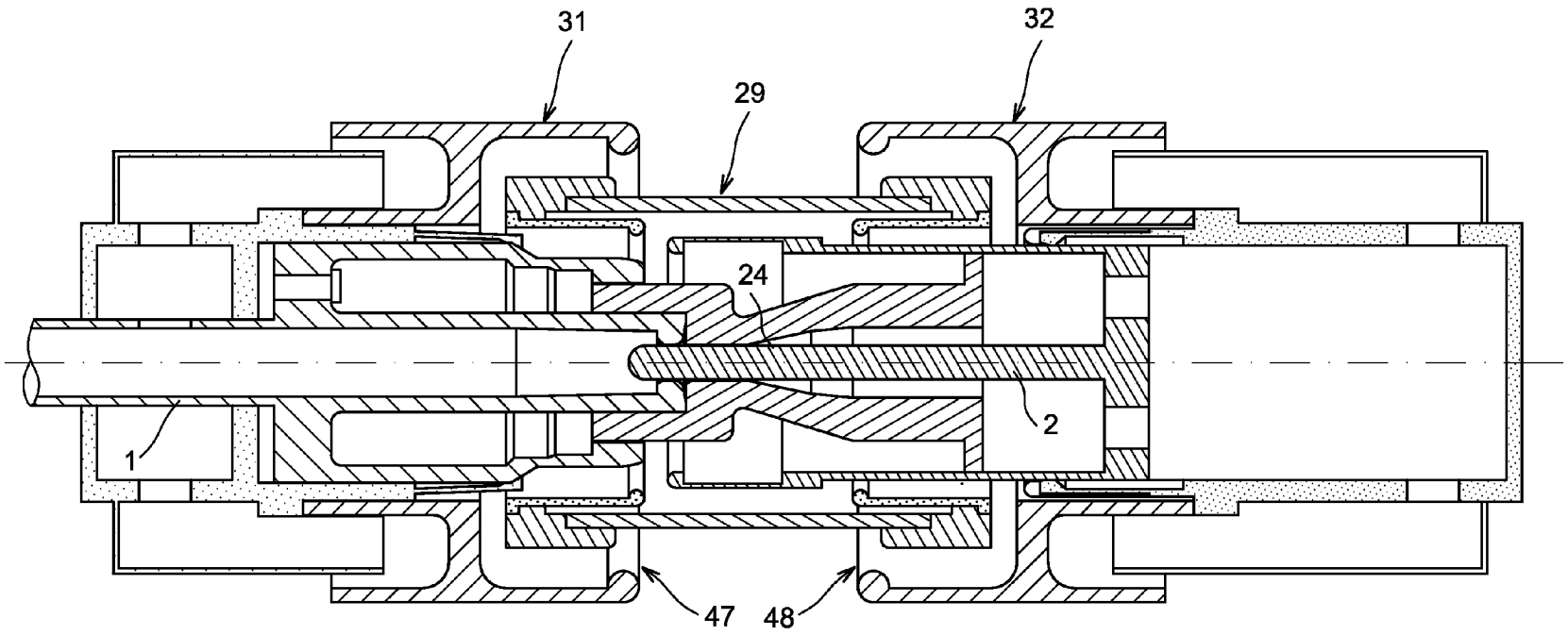
FIG. 4 is a view of the invention with the contacts in the closed state.

Reference is made initially to FIGS. 1 and 4. The arc-control chamber comprises a movable contact electrode (1)

and a stationary contact electrode (2) on the same axis. The electrodes (1 and 2) are supported by stationary contact carriers (3 and 4), each comprising in particular a respective sleeve (5 or 6) in which the corresponding electrode (1 or 2) is engaged and provided with a spring blade (7 or 8) for making electrical connection with the electrode (1 or 2). They include passages (9 and 10) in their rear portions opening out into chambers inside the sleeves (5 and 6), and then, via other passages (11 and 12) through the sleeves (5 and 6) opening out into annular chambers (13 and 14) that extend between the sleeves (5 and 6) on the inside and cylindrical edgings (15 and 16) on the outside, further including connections (17 and 18) to the sleeves (5 and 6) at the rear, but open at the front, i.e. towards the opposite electrode (2 or 1). The entire piece of switchgear is located in a tank (not shown). The gas content is generally sulfur hexafluoride $SF_6$ or some other highly dielectric gas.

The electrodes (1 and 2) present external contact portions (19 and 20) and inner contact portions (21 and 22) surrounded by the outer portions, and remaining in mutual contact longer than the outside portions when the device opens, and between which an arc (23) is struck when the contacts open. An arc-blast nozzle (24) of dielectric material connects the electrodes (1 and 2) together, surrounding the inner contact portions (21 and 22) and confining the arc (23). The arc (23) is blasted by conventional means, e.g. by expansion of the gas initially contained in a compressed chamber (25) between a partition (26) of the sleeve (5) and the movable electrode (1) and that is blasted ahead of the electrode (1) towards the arc (23) via an opening (27) through the end wall of said electrode, as soon as the compression becomes sufficient for opening a check valve (28) fitted in said opening (27).

Figure 3:
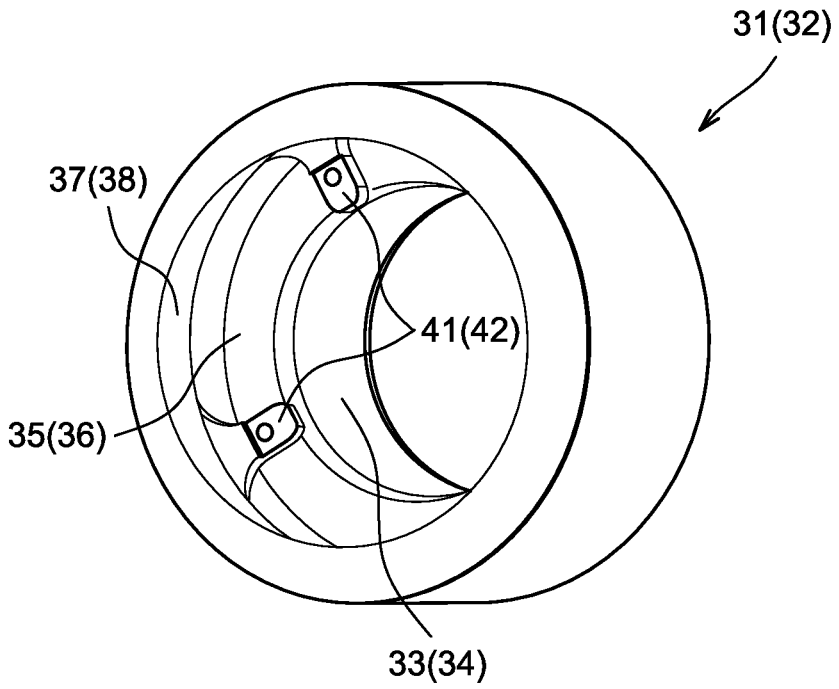
FIG. 3 is a perspective view of a collar.

The electrodes (1 and 2) are centered by a cap (29) having a main portion (30) of cylindrical shape and two collars (31 and 32) that are fastened respectively to the contact carriers (3 and 4). The main portion (30) is dielectric, while the collars (31 and 32) may be made of conductive material; they are more or less identical. Each of them comprises a support ring (33 or 34) making the connection with the sleeve (5 or 6), a plane continuous partition (35 or 36) extending around the support ring (33 or 34) and projecting beyond the main portion (30) in a radial direction (perpendicular to the axis of the electrodes (1 or 2)), a cylindrical front bushing (37 or 38) extending from the outer edge of the continuous partition (35 or 36) towards the other collar (32 or 31), and a rear bushing (39 or 40) that is likewise cylindrical and opposite from the front bushing, extending rearwards from the outer edge of the continuous partition (35 or 36) and surrounding the end of the sleeve (15 or 16), that comes quite close to the partition (35 or 36). Tabs (41 or 42)—more visible in FIG. 3—project from the continuous partitions (35 or 36) beside the front bushings (37) and serve to support inner portions (43 or 44) of the collars (31 or 32). The ends of the main portion (30) of the cap (29) are crimped in these inner portions (43 and 44). The cap (29) is a single piece, with screws (59 or 60) uniting the inner portions (43 or 44) with the continuous partitions (35 or 36). Each of the inner portions (43 or 44) also supports a respective field electrode (45 or 46) that surrounds the front end of the outer portion (19 or 20) of one of the contact electrodes (1 or 2) without touching it. The field electrodes (45 and 46) are directed towards each other.

The cap (29) is pierced by openings (47 or 48), each extending through the corresponding collar (31 or 32) and including a first portion (49 or 50) extending between the continuous partition (35 or 36) and the inner portion (43 or 44), and between the tabs (41 or 42), a second portion (51 or 52) extending between the front bushing (37 or 38) and the inner portion (43 or 44), and a third portion (53 or 54) at the end of the front bushing (37 or 38) at the location of an end presenting a bead (55 or 56) that projects inwards and is of rounded shape.

The invention operates as follows. When the contacts are closed, the gas contained in the cap (29) heats up and convection occurs through the openings (47 and 48); the lighter hot gas leaves the inside volume (57) confined by the cap (29) through the top openings, while gas coming from the outside volume (58) surrounding the cap (29) replaces it through the bottom openings. This achieves satisfactory ventilation of the electrodes (1 and 2).

When the contacts are opened and an arc (23) appears, the hot gas produced thereby is initially delivered into the annular chambers (13 and 14) and then blown against the collars (31 and 32), however the continuous partitions (35 and 36) stop the gas, and the rear bushings (39 and 40) reverse the gas, thereby directing it away from the outside volume (58), and preventing it from reaching the openings (47 and 48).

Figure 2:
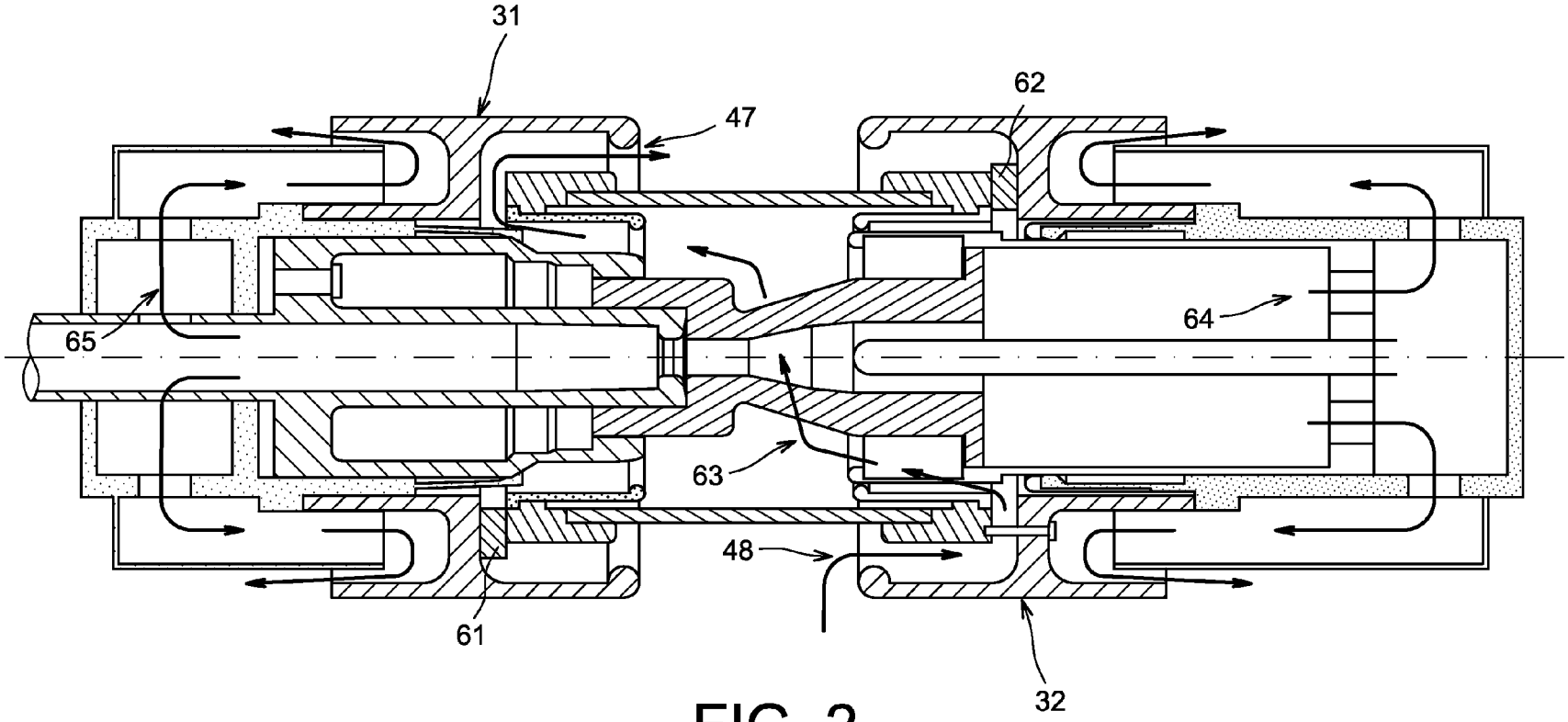
FIG. 2 shows a variant of this embodiment.

In a particular embodiment shown in FIG. 2, the openings (47) in one of the collars (31) are situated at the top, and the openings (48) in the other collar (32) are situated at the bottom, or more generally the openings in the collars are placed solely in angular sectors that are opposite each other around the circumferences of the collars (31 and 32), thereby causing the ventilation gas to follow a diagonal path passing through the middle of the inside volume (57), thus guaranteeing good ventilation. This variant may be implemented by adding stoppers (61 and 62) that block the sections of the other openings between the tabs (41 and 42).

FIG. 2 represents the convection flow by means of arrows (63), and also represents the movements whereby hot gas is exhausted in the event of an electric arc being interrupted by means of arrows (64 and 65). The embodiment of FIG. 1 also includes convection movements that are symmetrical to those of the arrows (63).

The collars (31 and 32) may be made at low cost as aluminum castings. The openings (47, 48) are given large dimensions so as to allow the desired convection flow rate. The sinuous shape of the openings is not particularly desired but results from the existence of the front bushings (37, 38) and of the field electrodes (45, 46) in the embodiments that are shown; rectilinear openings could be selected if those elements are not present.

The invention claimed is:

1. An arc-control chamber gear comprising two contact electrodes movable between a closed position and an open position, two contact carriers supporting the electrodes, each contact carrier comprising a sleeve provided with a first opening, the first opening of each said contact carrier establishing a first flow path between an inside volume of the sleeve and an outside volume of the sleeve, and a cap joining the contact carriers together and surrounding facing portions of the electrodes, the cap comprising a main dielectric portion and two collars connecting ends of the main portion to the contact carriers, wherein each of the collars comprises second openings causing an inside volume of the cap, in which said facing portions of the electrodes extend, to communicate with an outside volume of the cap and surrounding the inside volume of the cap, the second openings are arranged through the collars, around the sleeves of the contact carriers and around the electrodes, remain unobstructed, provide a second flow path from the outside volume of the cap through at least some of the second openings of a first one of the collars, the inside volume of the cap and at least some of the second openings of a second one of the collars, the second flow path returning to the outside volume of the cap, and the second openings are arranged only at opposite angular sections around a circumference of each collar.

2. An arc-control chamber gear comprising two contact electrodes movable between a closed position and an open position, two contact carriers supporting the electrodes, each contact carrier comprising a sleeve provided with a first opening, the first opening of each said contact carrier establishing a first flow path between an inside volume of the sleeve and an outside volume of the sleeve, and a cap joining the contact carriers together and surrounding facing portions of the electrodes, the cap comprising a main dielectric portion and two collars connecting ends of the main portion to the contact carriers, wherein each of the collars comprises second openings causing an inside volume of the cap in which said facing portions of the electrodes extend to communicate with an outside volume of the cap and surrounding the inside volume of the cap, the second openings are arranged through the collars, around the sleeves of the contact carriers and around the electrodes, remain unobstructed, and only at opposite angular sections around a circumference of each collar.

3. The arc-control chamber gear according to claim 2, wherein the second openings impose a diagonal path on the flow of ventilation gas by convection, said diagonal path passing through a middle of the inside volume.

4. The arc-control chamber gear according to claim 2, wherein each of the collars comprises a continuous partition projecting beyond the main portion in a radially outward direction, and the second openings extend through the collars between the main portion and the continuous partitions.

5. The arc-control chamber gear according to claim 4, wherein each collar comprises a support ring on the corresponding contact carrier and an inner portion for supporting the main portion, the continuous partitions are joined to the support rings, and the second openings extend between the continuous partitions and the inner portions.

6. The arc-control chamber gear according to claim 5, wherein the inner portions are assembled to the continuous partitions and the second openings extend between tabs on the continuous partitions and against which the inner portions bear.

7. The arc-control chamber gear according to claim 5, wherein each collar comprises a front bushing joined to the continuous partition and surrounding the inner portion, the second openings also extending between the inner portion and the front bushing.

8. The arc-control chamber gear according to claim 7, wherein each front bushing includes, at a front end, a rounded bead projecting towards the main portion.

9. The arc-control chamber gear according to claim 4, wherein each contact carrier has outer edging defining a path for gas flow from an open rear end of the corresponding electrode, an edging opening facing the corresponding continuous partition, and each collar having a rear bushing joined to the continuous partition and surrounding one end of the corresponding outer edging.

10. The arc-control chamber gear according to claim 5, wherein each inner portion of the collars carries a field electrode, the field electrodes surrounding the contact electrodes and the second openings also extending between the contact electrodes and the field electrodes.

* * * * *